United States Patent [19]

Shuttle, Jr.

[11] 4,007,965

[45] Feb. 15, 1977

[54] METHOD OF RECOVERING USEFUL MINERALS FROM SUBTERRANEAN DEPOSITS THEREOF

[76] Inventor: Anthony J. Shuttle, Jr., 839 Rydal Road, Jenkintown, Pa. 19046

[22] Filed: July 18, 1975

[21] Appl. No.: 597,004

[52] U.S. Cl. ..... 299/11; 299/18; 299/19

[51] Int. Cl.[2] ..... E21C 27/20; E21C 41/00

[58] Field of Search ..... 299/11, 18, 19, 56

[56] References Cited

UNITED STATES PATENTS

| | | | |
|---|---|---|---|
| 3,167,354 | 1/1965 | Macaul et al. | 299/11 |
| 3,362,752 | 1/1968 | Densmore | 299/19 X |
| 3,834,761 | 9/1974 | Ray et al. | 299/56 X |
| 3,848,927 | 11/1974 | Livingston | 299/18 X |

FOREIGN PATENTS OR APPLICATIONS

| | | | |
|---|---|---|---|
| 1,221,173 | 7/1966 | Germany | 299/11 |

*Primary Examiner*—Ernest R. Purser
*Attorney, Agent, or Firm*—W. Wyclif Walton

[57] ABSTRACT

This invention relates to the recovery of valuable minerals from deposits thereof in the earth and is particularly directed to a method of mining which affords recovery of at least a major portion of a seam of valuable mineral lying relatively near the surface of the earth without seriously involving the destructive effects upon the environment, inherent in surface mining. In practicing the method a relatively small proportion of the overburden covering a seam of useful mineral is removed, for later replacement, and a proportion of the valuable mineral in the seam much greater than that underlying the removed overburden is recovered by operations conducted in the pit formed by removal of overburden from selected areas, the recovery of these portions of the mineral seam being conveniently accomplished by what is known as augur mining from spaced pits disposed in predetermined patterns relatively to the mineral seam.

1 Claim, 8 Drawing Figures

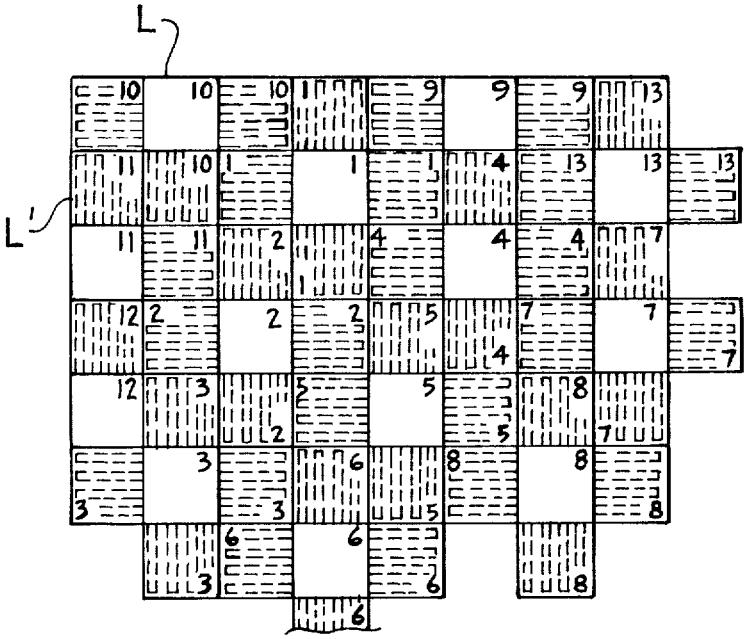
Fig. 4.
Fig. 5.
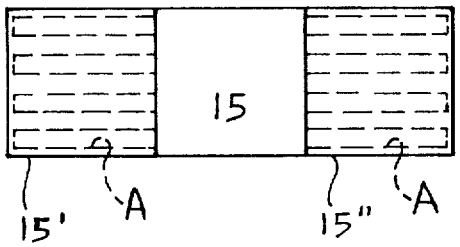
Fig. 6.
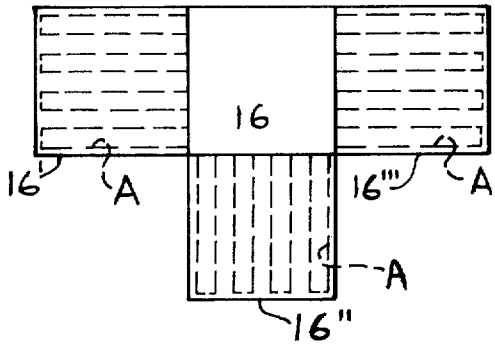
Fig. 7.
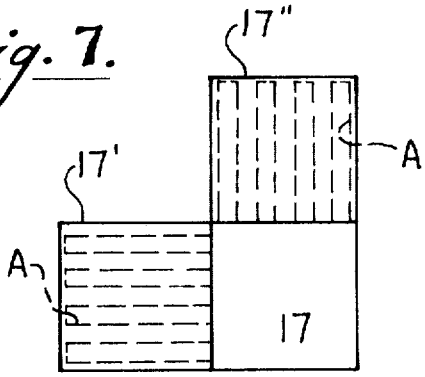
Fig. 8.
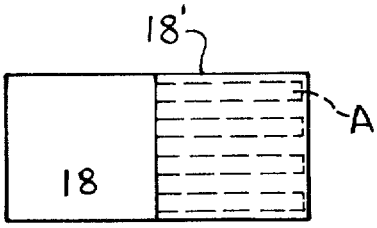

METHOD OF RECOVERING USEFUL MINERALS FROM SUBTERRANEAN DEPOSITS THEREOF

THE PRIOR ART

It is well known that valuable minerals have been recovered from the earth by what is known as surface mining, in accordance with which an overburden of soil, rock or other relatively non-commercially-useful material is removed to afford access to an often substantially horizontal layer or seam of a commercially useful mineral, such as coal, for example. It often occurs that these seams of useful minerals extend from outcroppings, as at a hill side, substantially horizontally under the hill consisting of overburden of increasing thickness as the mining operations progress from the vicinity of the outcropping edge of the seam. As the depth of this overburden increases it gradually becomes uneconomic to remove it and augur mining is resorted to, in accordance with which a large proportion of the mineral in the seam is removed for a distance inward from the mine face by auguring operations in which a plurality of parallel horizontal holes are drilled or augured into the seam, leaving between adjacent augur holes elongated pillars or bulkheads providing support for the superjacent overburden. The maximum length horizontally of these augured holes extending horizontally into the mineral seam is usually in the neighborhood of 200 to 250 feet, and after the valuable mineral has been recovered to that horizontal depth from the mine face the operation is usually abandoned, and the surface rehabilitated pursuant to applicable environmental standards.

In deep pit mining, of course, it is recognized that substantially vertical pits are sunk into the ground and horizontal galleries are constructed by removing the valuable minerals from seams as they are encountered at successively increasing depths from the surface.

SUMMARY OF THE INVENTION

The present invention may be viewed as providing a method which offers some of the advantages of surface mining as well as some of those attendant at upon deep pit mining in that it provides a method whereby through the conformity to predetermined patterns minerals which could not be recovered economically by either of said methods may be made susceptible of recovery, without serious impairment of the environment and with considerably less expense for restoration of surface conditions after the mineral has been recovered than is possible under present methods of surface mining.

BRIEF DESCRIPTION OF THE DRAWINGS

In the accompanying drawings

FIG. 4 is a fragmentary top plan view of a much reduced scale showing the distribution of mining operation patterns in accordance with the invention. For purposes of adequate illustration FIG. 4 represents an operation restricted on two sides by natural or artificial barriers such as property lines, mineral seam bounderies and the like, and FIGS. 5–8 inclusive are top plan views of patterns useful for adapting the more generally useful pattern of FIG. 1 to accomodate the limitations imposed by such barriers as those just mentioned.

DESCRIPTION OF THE PREFERRED EMBODIMENT

Figure 1:
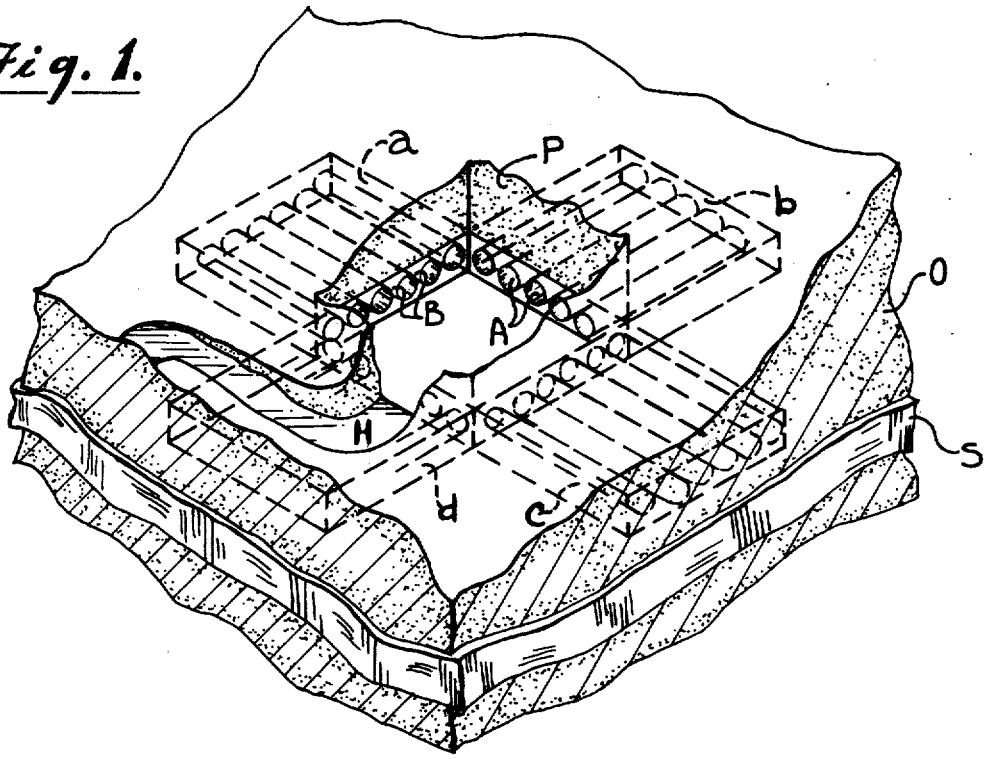
FIG. 1 is a perspective fragmentary view of a mineral recovery operation utilizing the method of the invention, which is not drawn to scale and in which certain dimensions are greatly exaggerated while others are minimized.
Figure 2:
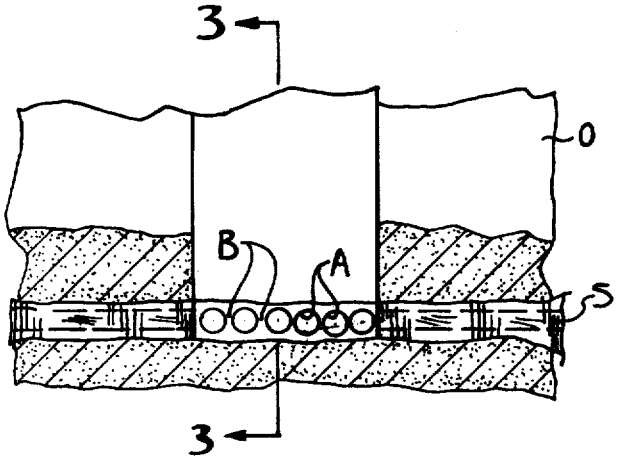
FIG. 2 is a front elevation of one of the mining faces of the pit illustrated in FIG. 1; reflecting like exaggeration of relative dimensions.
Figure 3:
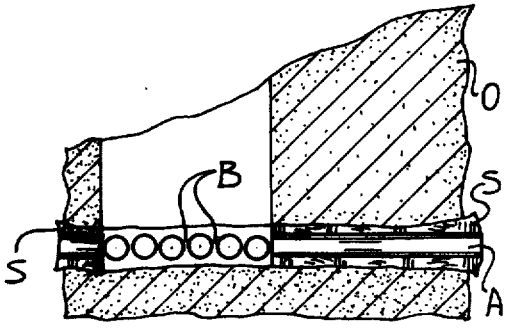
FIG. 3 is a front elevation, on line 3—3 in FIG. 2, illustrating another face of the said pit, the size of the augur holes and their frequency across the face of the pitside having no relation to the scale of contemplated operations.

Referring now more particularly to FIG. 1 there is represented therein an overburden O in a typical tract in a region of the earth containing a subterranean substantially horizontal seam S of a valuable mineral. It is assumed the overburden O is of such thickness relatively to the thickness of the seam S, taking into consideration the value of the mineral in the seam S and other factors, that it might be uneconomic to attempt to recover the mineral from seam S by either surface mining or deep pit operations, and hence, but for the availability of the present invention the mineral values of seam S could probably not be exploited advantageously under most economic conditions.

In accordance with the invention to secure access to seam S a rectangular pit P preferably substantially square in horizontal section is constructed through the overburden O to the seam. When the material of the overburden has been removed, in the removal of which a ramp or sloping highway H may be progressively constructed for vehicles transporting the overburden material, the upper surface of the seam S of valuable mineral is exposed, which can then by normal surface mining operations be recovered and removed to an appropriate installation for further processing.

After removal of the mineral of seam S at the bottom of the pit P augur mining equipment (not shown) is introduced to the pit and augur holes A are drilled into the faces of the seam exposed by the "surface" mining operations carried out at the bottom of the pit. These holes are usually in diameter about equal to the thickness of the seam S but when the seam is considerably thicker than the diameter of the largest drill head and augur available, a plurality of courses of augur holes may of course be drilled in accordance with usual practices. The comminuted mineral translated to the pit P by the augurs in drilling the said holes is of course transported elsewhere for processing as it is delivered to the pit by the augurs.

When the pit is substantially square in plan and for example, approximately 200 feet long on each side, a mineral seam 3 feet thick vertically might have up to 60 or possibly more holes A drilled into it from each face of the pit, leaving portions of the seam unexcavated between adjacent augur holes to provide elongated pillars or bulkheads B for supporting the overburden and preventing collapse of the latter after the mineral has been recovered.

As approximately 200 feet is the present practical limit of augur mining operations, in terms of distance from the mine face, I prefer to relate the size of the pit P thereto, which permits recovery by augur mining from each pit of mineral from an area in the seam approximately equal to four times the area of the pit itself. That is to say, using a pattern I prefer to designate as a "cross" pattern (FIG. 1) I mine by auguring areas in the seam S designated *a*, *b*, *c* and *d* extending in the seam from the several faces of the pit P, and each accounting for recovery by auguring from the seam mineral in quantity, except for that allowed to remain for pillars or bulkheads B, substantially equal to that made directly available for recovery by removal of the overburden through excavation of pit P.

By reference to FIG. 4 it will be evident that appropriate patterns can be juxtaposed to cover an entire area, such as that covered by the several patterns in FIG. 4, in which the pits of the several patterns are represented by numerals designating blank squares and the augur mined areas respectively appurtenent thereto are designated by like numerals but hatched in dotted lines to indicate the direction of the augur-mined holes driven through the mineral seam from the respective plane faces of the pits. It will be recognized, of course, that the number of these augur holes in each face is substantially greater than it is practical to illustrate in the drawings, and further that their diameters, in relation to the dimensions of pits are greatly exaggerated in the drawings.

Thus pits 1–8 inclusive, (FIG. 4) may have augured areas extending from each of the four sides of each pit, to afford total recovery of the mineral from the seam not only from the area of the pit itself, but also from approximately four times that area, in addition, by augur mining and without disturbing the overburden beyond the area of the pit itself, and provision for the vehicle ramp if one is employed. It is contemplated that such a vehicle ramp may be provided depending on circumstances when alternative removal of the mineral from the seam by vertical hoist or the like is uneconomical or other considerations do not militate against utilization of a ramp.

For mining a tract having peripheral limitations, either created, as by property lines which do not permit intrusion through the mineral seam from an adjacent tract, or natural limitations such as interposed by the edge of the seam, other patterns may be utilized, which while not so efficient individually from the standpoint of mineral recovery, may be used to avoid encroachment into forbidden areas while insuring that recovery from all available areas is effected.

Thus in FIG. 5 there is shown a pattern according to which a pit 15 affords access to two opposed augur mining areas 15', 15'' while in FIG. 6 pit 16 affords access to three augur mining areas, 16', 16'' and 16'''. In FIG. 7 access from pit 17 is afforded to two adjacent augur mining areas 17', 17'' while pit 18 in FIG. 8 may be utilized when space for only one augur mining area 18' is available.

These modified patterns are normally employed primarily to enable the entire available area of a seam to be mined, and are thus most useful adjacent the boundaries of a mining operation represented by lines L, L' in FIG. 4, wherein pit 9 and adjacent augur mining areas correspond to the pattern of FIG. 5, pit 10 to the pattern of FIG. 6, pit 11 to that of FIG. 7 while pit 12 shows the usefulness of the least efficient pattern, i.e. that illustrated in FIG. 8. Pit 13 in FIG. 4 is shown to demonstrate that any of the several modified patterns of FIGS. 5–8 inclusive may be repeated along a property line to enable the entire available seam area to be mined.

Thus, except for the relatively small amounts of valuable mineral left as supporting pillars or bulkheads B between adjacent augur holes A in augur-mined areas the method afforded by the invention permits mining of the entire area of a seam by surface mining operations, including augur mining, but with preservation of the original contours of substantially 80% of the surface with consequent reduction of approximately four fifths in the amount of rehabilitation required as compared with present surface mining operations. It thus becomes economical to mine deposits which are unsuitable for mining by deep-pit methods and uneconomical for mining by surface mining methods heretofore available, and with substantial improvement in the effect on the environment of the mining operation generally.

I claim:

1. The method of recovering minerals from a subterranean substantially horizontal seam thereof underlying an overburden layer, the steps of excavating in the overburden layer a pit exposing at its bottom a substantially square area of the mineral seam, recovering the mineral from the seam in said area, then projecting from each side of said area an extraction operation removing mineral of the seam into said pit from a substantially square area extending from each of said sides under the overburden layer, then excavating in the overburden layer another pit substantially congruent with said first pit exposing at its bottom another substantially square area of the mineral seam having one side extending in prolongation of a side of said first area, said second area extending oppositely from said first area in respect to the line common to said sides of said areas, said areas being spaced apart along said common line a distance approximately equal to each of the several sides of said areas, then projecting from each side of said second area an extraction operation removing mineral of the seam into said second pit from a substantially square area extending from each of the sides of said second area, the area of such removal extending from one of the sides of the second pit into substantial encounter with two of the extraction areas projected from adjacent sides of said first pit, then excavating similar square pits and areas under the overburden extending from the sides of each of said pits into the seam in like manner until extraction of the mineral of the seam has been substantially completed and after extraction of the mineral of the seam to said pits removing the mineral from said pits and finally returning to the pits overburden excavated therefrom to restore the surface substantially to the condition existing before the initiation of the mining operation.

* * * * *